US005567935A

United States Patent [19]

Fajardo et al.

[11] Patent Number: 5,567,935

[45] Date of Patent: Oct. 22, 1996

[54] VELOCITY SELECTED LASER ABLATION METAL ATOM SOURCE

[75] Inventors: Mario E. Fajardo; Michel Macler, both of Lancaster, Calif.

[73] Assignee: The United States of America as represented by the Secretary of the Air Force, Washington, D.C.

[21] Appl. No.: 458,518

[22] Filed: Jun. 2, 1995

[51] Int. Cl.[6] ..... H01J 3/04

[52] U.S. Cl. ..... 250/251; 250/423 P

[58] Field of Search ..... 250/251, 423 P, 250/288, 288 A

[56] References Cited

U.S. PATENT DOCUMENTS

| | | | |
|---|---|---|---|
| 4,105,921 | 8/1978 | Bartlett et al. | 250/423 P |
| 4,740,692 | 4/1988 | Yamamoto et al. | 250/423 P |
| 5,019,705 | 5/1991 | Compton | 250/251 |
| 5,115,439 | 5/1992 | Howard | 372/37 |
| 5,268,921 | 12/1993 | McLellan | 372/87 |
| 5,295,009 | 3/1994 | Barnik et al. | 359/65 |

*Primary Examiner*—Jack I. Berman
*Assistant Examiner*—Kiet T. Nguyen
*Attorney, Agent, or Firm*—Robert L. Nathans

[57] ABSTRACT

A pulsed plume of laser ablated photo-ionizable material is emitted from a target in a vacuum, and a pulsed beam of light thereafter produces ionization of two plume sections straddling a central nonionized plume portion. A mask is provided, intermediate the plume and the laser generating the ionizing pulsed beam of light, to shield the central plume portion to prevent ionization thereof. The ionized portions of the plume are swept away from the vicinity of the non-ionized plume portion by a magnetic field, and the remaining nonionized portion passes through an aperture in a retrieval mask to produce the output of the atomic source.

20 Claims, 1 Drawing Sheet

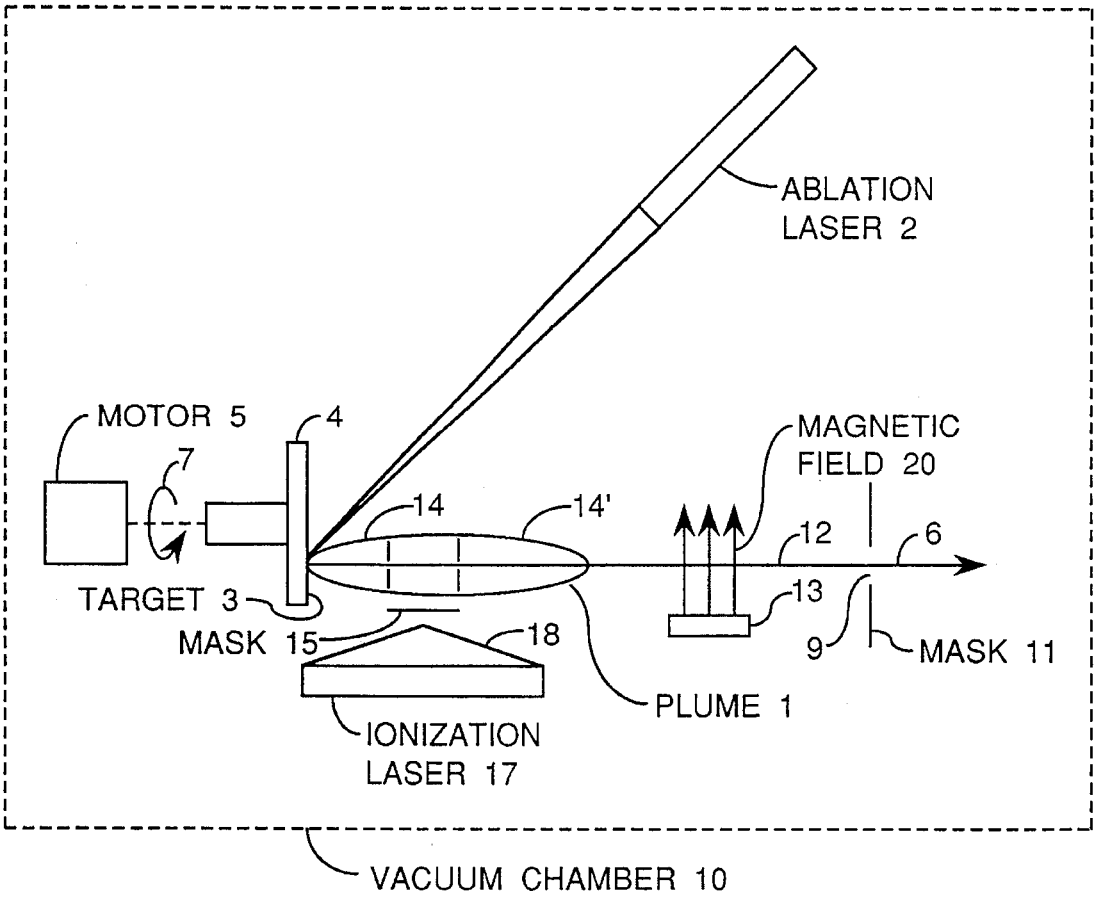
ABLATION
LASER 2
MOTOR 5
4
7
MAGNETIC
FIELD 20
14
14'
12
6
TARGET 3
13
MASK 15
18
9
MASK 11
PLUME 1
IONIZATION
LASER 17
VACUUM CHAMBER 10

VELOCITY SELECTED LASER ABLATION METAL ATOM SOURCE

STATEMENT OF GOVERNMENT INTEREST

The invention described herein may be manufactured and used by or for the Government for governmental purposes without the payment of any royalty thereon.

BACKGROUND OF THE INVENTION

Traditional methods of producing beams of velocity selected neutral atomic or molecular species do not work well throughout the 1 to 20 eV kinetic energy range, for which atomic velocities can exceed one million cm/sec. Standard mechanical velocity selection techniques are limited to maximum transmitted velocities of about 100,000 cm/sec, or they require very long atomic flight distances of about 100 cm. Beams of nearly monoenergetic very fast neutral species can be produced routinely by charge exchange neutralization of a beam of suitable parent ions. However, this technique fails for kinetic energies below about 10 eV due to space charge limitations on the intensity of the parent ion beam.

The laser ablation into vacuum process provides a compact source of intense beams of neutral and ionic species throughout the desired kinetic energy range, but with very broad kinetic energy distributions.

SUMMARY OF A PREFERRED EMBODIMENT OF THE INVENTION

The present invention combines the best features of the laser ablation process with a non-mechanical velocity selection arrangement capable of operating in the desired kinetic energy range. Kinetic energy is of course proportional to the velocity squared. In accordance with a preferred embodiment of the invention, a target is positioned in a vacuum chamber, which target comprises a material which can be photo-ionized. A pulsed plume of ablated photo-ionizable particulate material, emerging from the target, is projected along a projection axis within the vacuum chamber, and a pulsed beam of light, capable of ionizing the plume, intersects selected portions of the plume to create two ionized portions, separated by a non-ionized portion therebetween. A magnetic field then sweeps the ionized plume portions away from the projection axis and the non-ionized portion is retrieved by an apertured mask having its aperture positioned on the projection axis.

BRIEF DESCRIPTION OF THE DRAWING

Other features of the invention will become apparent upon study of the following detailed description of preferred embodiments of the invention, taken in conjunction with the sole FIGURE schematically illustrating an embodiment of the invention.

DETAILED DESCRIPTION

In the sole FIGURE, and within vacuum chamber 10, a pulsed plume 1 of metal atoms, ions, molecules, clusters and metal particles can be produced by focussing the output of a pulsed ablation laser 2 upon the surface 4 of a rotating target 3 held in a vacuum chamber. The atomic beam 6, which is the output product of the atomic source, passes through an aperture 9 of retrieval mask 11 positioned upon the plume projection axis 12. Motor 5 produces rotation of target 3 as indicated by 7. Typically, the kinetic energies and total flux of the constituents of the beam can be increased by increasing the incident fluence, (power/area), of the ablation laser 2.

For the purposes of the present invention, the metal ions, molecules, clusters, and particles are unwanted contaminants in the atomic beam and can be reduced by restricting the incident fluence of the ablation laser 2 to values within a few times the threshold for producing visible emissions from the plume, or by using very short picosecond ablation pulses; see F. Mueller et al., Proc. SPIE-Int. Soc. Opt. Eng. vol. 1858, pp. 464–475 (1993). This consideration requires the selection of a compromise value of the ablation laser fluence, with beam energy and flux being traded off for beam purity. The ions which survive the plume expansion are deflected upwardly by magnetic field 20, are swept away from projection axis 12, and thus fail to pass through aperture 9 of beam retrieval mask means 11.

Operating the beam source as described, provides a beam composed predominantly of metal atoms with kinetic energies in the 1–20 eV range, with however, a very broad distribution of kinetic energies which is reduced by our novel method of velocity selection. The method is based upon the spatial separation of the different velocity components of the plume following a short delay after the arrival of the ablation laser pulse, that is, the faster metal atoms move farther away from the metal target surface 4 than do the slow ones in the same amount of time. Thus, only those metal atoms having the proper velocities to be retrieved to form the output beam, are hidden behind opaque mask 15, and thus avoid being ionized when the pulse 18 from the ionization laser 17 intercepts the photo-ionizable plume 1. This action creates a pair of photo-ionized plume sections 14 and 14' to the right and left of the mask 15, which ionized plume sections are swept away from axis 12 by magnetic field 20, produced by magnetization means 13. The result of this action is that only those nonionized atoms behind the mask 15 will remain on the projection axis 12 to pass through aperture 9 of the retrieval mask 11 to be outputted from the device with the desired pass velocity. The peak of the velocity distribution of these unaffected nonionized atoms behind mask 15 is related to the distance d between the target surface 4 and the center of the mask, and the time delay between the production of the laser ablation pulse and the ionization laser pulse. The pass velocity will be equal to the distance d divided by this time delay. The width of the velocity distribution of the velocity selected metal atoms decreases as the mask is made narrower, down to a limit imposed by the finite duration of the ablation laser pulses and the initial plume formation process, and the finite duration of the ionization laser pulses together with diffraction limitations on imaging the masked ionization laser pulse onto the plume.

Some operating parameters of our first demonstration experiment were as follows: pulses from a xenon-chloride eximer ablation laser: pulse energy 10 milli-joule, 308 nm wavelength, were focused upon a high purity A1 target. The ablation laser beam was focused down to a spot of 0.05×0.10 cm and had a duration of 0.03 microseconds. The magnetic field had a magnetic field strength of 2.8 kilo-Gauss. Aperture 9 had a diameter of 0.2 cm, formed in a 0.05 cm thick steel sheet, placed 6 cm from the target surface. An ArF ionization laser was employed and the photoionization process was very efficient, such that about 98% of the unwanted aluminum atoms was readily ionized and rejected. Photoionization mask 15 consisted of a 0.15 cm wire placed 0.5 cm from the target surface and photoionization was accomplished by unfocused 100 mJ pulses of 0.25 microsecond duration, delayed by 0.94 microseconds from the ablation laser pulse. These conditions resulted in a pass velocity of 500,000 cm/sec and a peak pass energy of 4 eV.

For additional examples of demonstrated operating conditions for Al atoms, see M. Macler and M. E. Fajardo, Appl. Phys. Lett., vol. 65, pages 2275–2277, (31 Oct., 1994). For information concerning our recent demonstration of the temporally and spatially specific photoionization (TASSPI) effect for gallium and indium atoms, see M. E. Fajardo and M. Macler, Material Research Society, Symposium Proceedings, vol. 388, (1995).

Variations on the aforesaid components and parameters will occur to skilled workers in the art and thus the scope of the invention is to be restricted only by the terms of the following claims and art recognized equivalents thereof.

What is claimed is:

1. An atom source comprising:

(a) a target of a material which can be photoionized, positioned within a vacuum chamber:

(b) ablation means for projecting a pulsed plume of ablated photo-ionizable material from said target along a projection axis positioned within said vacuum chamber;

(c) an ionization laser for directing a pulsed light beam capable of ionizing said plume of ablated ionizable material, toward said projection axis;

(d) retrieval means positioned along said projection axis for retrieving only selected material particles from said plume;

(e) light beam control means for causing only selected portions of said pulsed light beam generated by said ionization laser to intersect said plume to produce ionized plume portions; and (f) means for producing a magnetic field for sweeping said ionized plume portions away from said projection axis to prevent retrieval of said ionized plume portions by said retrieval means.

2. The source of claim 1 wherein said ablation means comprises an ablation laser.

3. The source of claim 2 wherein said beam control means comprises masking means for shielding a selected plume portion from the pulsed light beam generated by said ionization laser.

4. The source of claim 3 wherein said retrieval means comprises an apertured mask for permitting a nonionized plume portions to pass therethrough.

5. The source of claim 4 further including means for rotating said target during operation of said ablation means.

6. The source of claim 3 further including means for rotating said target during operation of said ablation means.

7. The source of claim 2 wherein said retrieval means comprises an apertured mask for permitting a nonionized plume portion to pass therethrough.

8. The source of claim 2 further including means for rotating said target during operation of said ablation means.

9. The source of claim 1 wherein said beam control means comprises masking means for shielding a selected plume portion from the pulsed light beam generated by said ionization laser.

10. The source of claim 9 wherein said retrieval means comprises an apertured mask for permitting a nonionized plume portion to pass therethrough.

11. The source of claim 9 further including means for rotating said target during operation of said ablation means.

12. The source of claim 1 wherein said retrieval means comprises an apertured mask for permitting a nonionized plume portion to pass therethrough.

13. Atomic source apparatus comprising:

(a) a target of a material which can be ionized, positioned within a vacuum chamber;

(b) means for directing a pulsed plume of ablated ionizable material from said target toward a first portion of said apparatus;

(c) pulsed ionization means for ionizing selected portions of said plume to create ionized plume portions and a nonionized plume portion;

(d) magnetizing means for causing a magnetic field to sweep said ionized plume portions away from said first portion of said apparatus; and (e) retrieval means, positioned at the first portion of said apparatus, for retrieving said nonionized plume portion.

14. The source of claim 13 further including means for rotating said target.

15. The source of claim 13 wherein said retrieval means comprises an apertured mask.

16. The source of claim 15 wherein said pulsed ionization means includes a mask for preventing ionization of a portion of said plume positioned between the selected portions of said plume being ionized.

17. The source of claim 13 wherein said pulsed ionization means includes a mask for preventing ionization of a portion of said plume positioned between said selected portions of said plume being ionized.

18. A method of generating an atomic beam comprising the steps of:

(a) providing a target of a material which can be photoionized, positioned within a vacuum;

(b) generating a pulsed plume of ablated ionizable material from said target and projecting said pulsed beam of ablated ionizable material along a projection axis positioned within said vacuum;

(c) directing pulsed beams of light, capable of ionizing said plume of ablated ionizable material, through selected portions of said plume to create ionized plume portions;

(d) causing a magnetic field to sweep said ionized plume portions away from said projection axis; and (e) retrieving a nonionized plume portion positioned along said projection axis.

19. A method of generating an atomic beam comprising the steps of:

(a) ionizing portions of a plume of ionizable material to form ionized plume portions;

(b) causing a magnetic field to drive said ionized plume portions in a direction away from a predetermined area; and (c) retrieving a nonionized plume portion within said predetermined area.

20. The method of claim 19 wherein the steps thereof are carried out in a vacuum.

* * * * *